US006296584B1

(12) United States Patent
West et al.

(10) Patent No.: US 6,296,584 B1
(45) Date of Patent: Oct. 2, 2001

(54) BASE WITH RIGID CORNER SECTION

(76) Inventors: Frank J. West, 23041 Melrose St., East Pointe, MI (US) 48021; Timothy J. Boomer, 28632 Citation St., Roseville, MI (US) 48066

( * ) Notice: Subject to any disclaimer, the term of this patent is extended or adjusted under 35 U.S.C. 154(b) by 0 days.

(21) Appl. No.: 09/288,134

(22) Filed: Apr. 8, 1999

(51) Int. Cl.[7] ..... A63B 71/00
(52) U.S. Cl. ..... 473/499
(58) Field of Search ..... 473/499, 501, 473/FOR 102, FOR 103

(56) References Cited

U.S. PATENT DOCUMENTS 1,244,044 * 10/1917 Falconer, Sr. ..... 473/499
3,572,705 * 3/1971 Wyble ..... 473/499
3,836,146 * 9/1974 Golomb ..... 473/499
3,938,804 * 2/1976 Fuller et al. ..... 473/499
4,493,486 * 1/1985 Fuller et al. ..... 473/499
5,456,460 * 10/1995 Larsen ..... 473/499
5,772,539 * 6/1998 Hall ..... 473/499

* cited by examiner

*Primary Examiner*—Jeanette Chapman
*Assistant Examiner*—Mitra Aryanpour

(57) ABSTRACT

A base is provided with a first section constructed from a material of a first degree of rigidity. A remaining second section of the base is formed integral with the first section and is constructed from a material of a second degree of rigidity less than the first degree of rigidity.

7 Claims, 1 Drawing Sheet

BASE WITH RIGID CORNER SECTION

BACKGROUND OF THE INVENTION

1. Field of the Invention

The present invention relates to baseball/softball bases and more particularly pertains to a new base with rigid corner section for reducing the risk of injury while playing baseball/softball.

2. Description of the Prior Art

The use of baseball/softball bases is known in the prior art. More specifically, baseball/softball bases heretofore devised and utilized are known to consist basically of familiar, expected and obvious structural configurations, notwithstanding the myriad of designs encompassed by the crowded prior art which have been developed for the fulfillment of countless objectives and requirements.

Known prior art baseball/softball bases include U.S. Pat. Nos. 4,723,779; 4,979,740; 4,817,946; 3,971,558; 5,203,557; and U.S. Des. Pat. No. 252,938.

In these respects, the base with rigid corner section according to the present invention substantially departs from the conventional concepts and designs of the prior art, and in so doing provides an apparatus primarily developed for the purpose of reducing the risk of injury while playing baseball/softball.

SUMMARY OF THE INVENTION

In view of the foregoing disadvantages inherent in the known types of baseball/softball bases now present in the prior art, the present invention provides a new base with rigid corner section construction wherein the same can be utilized for reducing the risk of injury while playing baseball/softball.

The general purpose of the present invention, which will be described subsequently in greater detail, is to provide a new base with rigid corner section apparatus and method which has many of the advantages of the baseball/softball bases mentioned heretofore and many novel features that result in a new base with rigid corner section which is not anticipated, rendered obvious, suggested, or even implied by any of the prior art baseball/softball bases, either alone or in any combination thereof.

To attain this, the present invention generally comprises a base having a square top face, a square bottom face, and four thin, equally sized rectangular side faces. Such side faces are formed between the top face and the bottom face in perpendicular relationship therewith. The base has a corner section defined by an equal length of both a first side face and a second side face adjacent to the first side face. The corner section is further defined by vertical planes extending in perpendicular relationship with the first and second side faces. As such, the corner section has a square top and bottom face. It should be noted that the corner section of the base is constructed from a material of a first degree of rigidity. A remaining section of the base is formed integral with the corner section. This remaining section is constructed from a material of a second degree of rigidity less than the first degree of rigidity. For allowing the differentiation between the sections of the base, the corner section of the base is colored a first color while the remaining section of the base is colored a second color.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new base with rigid corner section apparatus and method which has many of the advantages of the baseball/softball bases mentioned heretofore and many novel features that result in a new base with rigid corner section which is not anticipated, rendered obvious, suggested, or even implied by any of the prior art baseball/softball bases, either alone or in any combination thereof.

It is another object of the present invention to provide a new base with rigid corner section which may be easily and efficiently manufactured and marketed.

It is a further object of the present invention to provide a new base with rigid corner section which is of a durable and reliable construction.

An even further object of the present invention is to provide a new base with rigid corner section which is susceptible of a low cost of manufacture with regard to both materials and labor, and which accordingly is then susceptible of low prices of sale to the consuming public, thereby making such base with rigid corner section economically available to the buying public.

Still yet another object of the present invention is to provide a new base with rigid corner section which provides in the apparatuses and methods of the prior art some of the advantages thereof, while simultaneously overcoming some of the disadvantages normally associated therewith.

Still another object of the present invention is to provide a new base with rigid corner section for reducing the risk of injury while playing baseball/softball.

Even still another object of the present invention is to provide a new base includes a first section constructed from a material of a first degree of rigidity. A remaining second section of the base is formed integral with the first section and is constructed from a material of a second degree of rigidity less thin the first degree of rigidity.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
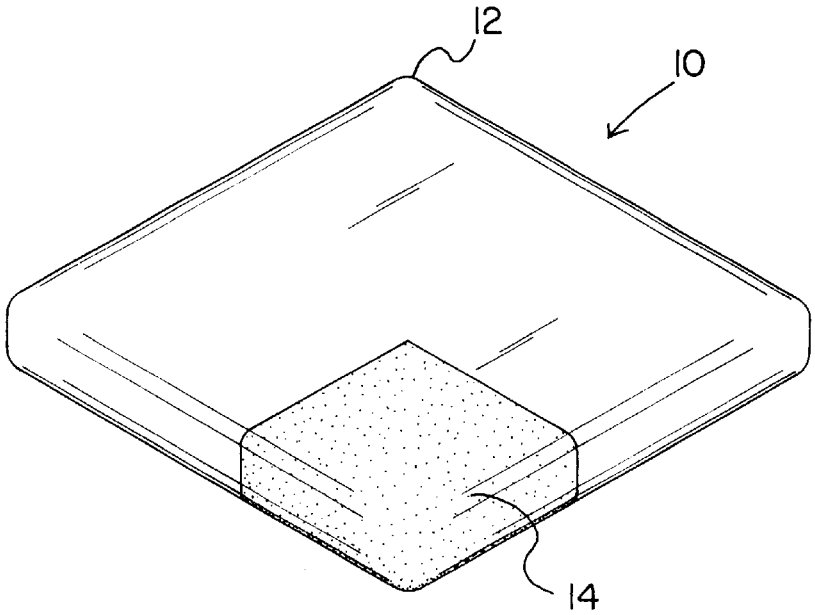
FIG. 1 is a perspective view of a new base with rigid corner section according to the present invention.
Figure 2:
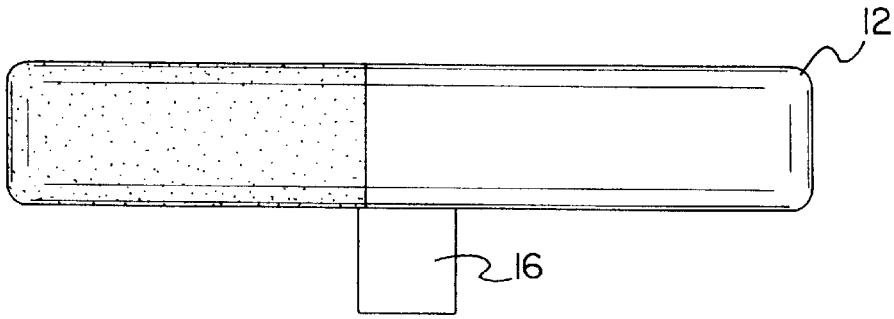
FIG. 2 is a side view of the present invention.

With reference now to the drawings, and in particular to FIGS. 1 through 2 thereof, a new base with rigid corner section embodying the principles and concepts of the present invention and generally designated by the reference numeral 10 will be described.

The present invention, designated as numeral 10, includes a base 12 having a square top face, a square bottom face, and four thin, equally sized rectangular side faces. Such side faces are formed between the top face and the bottom face in perpendicular relationship therewith.

The base has a corner section 14 bounded by an equal length of both a first side face and a second side face adjacent to the first side face. As shown in FIG. 2, such length is between ¼ and ½ that of the base. It should be noted, however, that the dimensions of the corner section may be varied as desired. The corner section is further bounded by vertical planes extending in perpendicular relationship with the first and second side faces. As such, the corner section has a square top and bottom face. It should be understood that additional sections may be incorporated if desired.

The corner section of the base is constructed from a material of a first degree of rigidity. A remaining section of the base is formed integral with the corner section. This remaining section is constructed from a material of a second degree of rigidity less than the first degree of rigidity. In the preferred embodiment, silicon of varying degrees of rigidity is utilized to construct the base.

For allowing the differentiation between the sections of the base, the corner section of the base is colored a first color while the remaining section of the base is colored a second color. It is preferred that a sharp contrast be afforded between the sections with the corner section being emphasized. As such, the first color is preferably bright orange and the remaining section is ideally a more subtle color such as white. However, all colors of the rainbow may be used, and may be varied to suit the preferences of individual customers (such as, for example, using a person's favorite college colors or team colors).

Lastly, a rigid post 16 is provided having a rectangular configuration. The post is coupled to a central extent of the bottom face of the base and depends vertically therefrom for being mounting within earth. The rigid post may be of a special design, original plastic yet contoured to the specifications of minimum. In the preferred embodiment, a plurality of the bases of the present invention are mounted on a baseball/softball diamond such that corner section is always closest to home plate.

In use, the present invention provides a base of varying rigidity for the purpose of reducing the risk of injury. This is accomplished by constructing a majority of the base from a softer material which is capable of giving under impact. Furthermore, benefits are accrued by the harder nature of the corner section. Such section provides a solid foundation for start-off running, tagging up, or rounding and further tagging purposes.

The variations attributed are set forth to accommodate every aspect of skill variation from beginner ("T-ball") to the most experienced player ("pro"), and the bases may be made slightly differently based upon the variations in skill level.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A baseball base comprising, in combination:

a base having a square top face, a square bottom face, and four thin, equally sized rectangular side faces formed between the top face and the bottom face in perpendicular relationship therewith;

said base having a corner section defined by an equal length of both a first side face and a second side face adjacent to the first side face, the corner section further defined by vertical planes extending in perpendicular relationship with the first and second side faces such that the corner section has a square top and bottom face, the corner section square top and square bottom face each having an area less than that of the square top and the square bottom face of the base respectively;

said corner section of the base being constructed from a material of a first degree of rigidity, wherein a remaining section of the base is formed integral with the corner section and is constructed from a material of a second degree of rigidity less than the first degree of rigidity of the material of the corner section for providing the corner section with greater firmness relative to the remaining section to provide a lead off corner location on the base for resting a foot against by an advancing base runner;

said corner section of the base being colored a first color and the remaining section of the base being colored a second color for permitting visual differentiation between the corner section and the remaining section when the runner is approaching the base; and a rigid post having a rectangular configuration coupled to a central extent of the bottom face of the base and depending vertically therefrom for being mounting within earth.

2. A baseball base comprising a corner section constructed from a material of a first degree of rigidity, wherein a remaining section of the base is constructed from a material of a second degree of rigidity less than the first degree of rigidity for providing the corner section with greater firmness relative to the remaining section to provide a lead off corner location on the base for resting a foot against by an advancing base runner; and wherein the corner and remaining sections are colored differently for permitting visual differentiation between the corner section and the remaining section when the runner is approaching the base.

3. A base as set forth in claim 2 wherein the corner section is formed on a corner of the base.

4. A base as set forth in claim 2 wherein the corner section extends between a top face and a bottom face of the base.

5. A baseball base comprising a first section constructed from a material of a first degree of rigidity, wherein a remaining second section of the base is constructed from a material of a second degree of rigidity less than the first degree of rigidity for providing the first section with greater firmness relative to the second section to provide a lead off corner location on the base for resting a foot against by an advancing base runner; and wherein the first and second sections are colored differently for permitting visual differentiation between the first section and the second section when the runner is approaching the base.

6. A baseball base as set forth in claim 5 wherein the first section is formed on a corner of the base.

7. A baseball base as set forth in claim 5 wherein the first section extends between a top face and a bottom face of the base.

* * * * *